US006283657B1

(12) United States Patent
Vann

(10) Patent No.: US 6,283,657 B1
(45) Date of Patent: Sep. 4, 2001

(54) ADJUSTABLE-LENGTH WRITING INSTRUMENT

(76) Inventor: Charles S. Vann, 1425 Drake Ave., Burlingame, CA (US) 94010

( * ) Notice: Subject to any disclaimer, the term of this patent is extended or adjusted under 35 U.S.C. 154(b) by 0 days.

(21) Appl. No.: 09/699,830

(22) Filed: Oct. 30, 2000

(51) Int. Cl.[7] ..... B43K 23/00
(52) U.S. Cl. ..... 401/95
(58) Field of Search ..... 401/6, 52, 88, 401/95, 195

(56) References Cited

U.S. PATENT DOCUMENTS

| | | | | |
|---|---|---|---|---|
| D. 409,658 | | 5/1999 | Chevaller | D19/51 |
| 3,759,622 | | 9/1973 | Miyamoto | 401/104 |
| 4,149,812 | | 4/1979 | Huffman, Jr. | 401/6 |
| 4,459,059 | | 7/1984 | Greenspan | 401/117 |
| 4,678,356 | * | 7/1987 | Garland | 401/95 |
| 4,833,902 | * | 5/1989 | Mori | 70/456 R |
| 4,896,983 | | 1/1990 | Im | 401/107 |
| 5,601,376 | | 2/1997 | Badr | 401/104 |
| 5,988,918 | * | 11/1999 | Johnson | 401/88 |

* cited by examiner

*Primary Examiner*—Gregory L. Huson
*Assistant Examiner*—Peter deVore

(57) ABSTRACT

The adjustable-length writing instrument is a pen or pencil cartridge fixed inside a substrate that is folded into an inner and outer portion such that the inner portion slides inside the outer portion to adjust the length of the instrument. In its extended length, the instrument is standard length, ready for writing and fitting comfortably in the hand. In its contracted length, the instrument is much shorter for easy storage, and the outer portion extends over the pen or pencil cartridge to prevent unintended markings. The instrument is light, flexible, simple, and it can be reconfigured from contracted to extended (or visa versa) with one-hand in about one second.

2 Claims, 1 Drawing Sheet

ADJUSTABLE-LENGTH WRITING INSTRUMENT

CROSS-REFERENCE TO RELATED APPLICATIONS

None

BACKGROUND

1. Field of Invention

This invention relates to writing instruments.

2. Description of Prior Art

There are many patents on writing instruments. However, these instruments generally have common features including a marking substance (e.g. ink, graphite), a rigid shaft to contain and enable a user to guide and deposit the marking substance onto an object. Also, most writing instruments have a means of capping or retracting the marking substance such that it does not write on unintended surfaces (e.g. Des. Patent 409,658 to Chevaller et al. and U.S. Pat. No. 5,601,376 to Badr et al.)

For the purpose of user comfort, the shaft is typically around six inches in length such that one end can be supported by a combination of fingers and the other end supported on the base of the hand between the thumb and first finger. A writing instrument much shorter than the standard length is not long enough to be supported by the base of the hand. Grasping with the fingers alone, it is difficult, awkward, and tiring to control the instrument, making it generally an unacceptable design.

However, the standard-length writing instrument has a fundamental problem in that it is generally too long and too rigid for easy storage on a person. Often the most convenient storage area on a person is a clothes pocket. But, the standard shirt pocket is smaller in both dimensions that a standard writing instrument, causing it to protrude from the pocket. For fashion and practical reasons (it can fall out or snag things), most users do not want a writing instrument protruding from their shirt pocket.

Pants pockets are generally long enough to hold the entire length of a standard instrument, but the instrument can cause discomfort and damage when the user sits down with the instrument in the pocket. For the same reasons, a standard length instrument is too long and rigid to fit inside a man's wallet, small notebook, electronic devices such as calculators and personnel digital assistants (PDAs), and some women purses.

Therefore, a writing instrument is needed that is standard length during use but can be made much shorter and smaller for storage. Folding is one means of making a pin long for operation but shorter during storage (for example, U.S. Pat. No. 4,149,812 to Huffman, Jr and U.S. Pat. No. 5,988,918 to Johnson). However, a folding instrument as described by Huffman does not reduce its volume only its length, and the user is not fully protect against inadvertent marking in its closed configuration. The folding instrument described by Johnson does not reduce volume either and is awkward and impractical to fold into a shorter length.

SUMMARY

In accordance with the present invention, a writing instrument is adjustable in length such that it is a comfortable and practical length when writing but it easily contracts to a much shorter length and smaller volume for easy storage.

DRAWING FIGURES

Reference is now made to the embodiment illustrated in FIGS. 1–2 wherein like numerals are used to designate like parts throughout.

REFERENCE NUMBERALS IN DRAWING

30 embodiment
31 substrate, A(inner), B(outer)
32 fold in substrate
33 pin or pencil cartridge
34 support layer

DESCRIPTION

Preferred Embodiment

Figure 1:
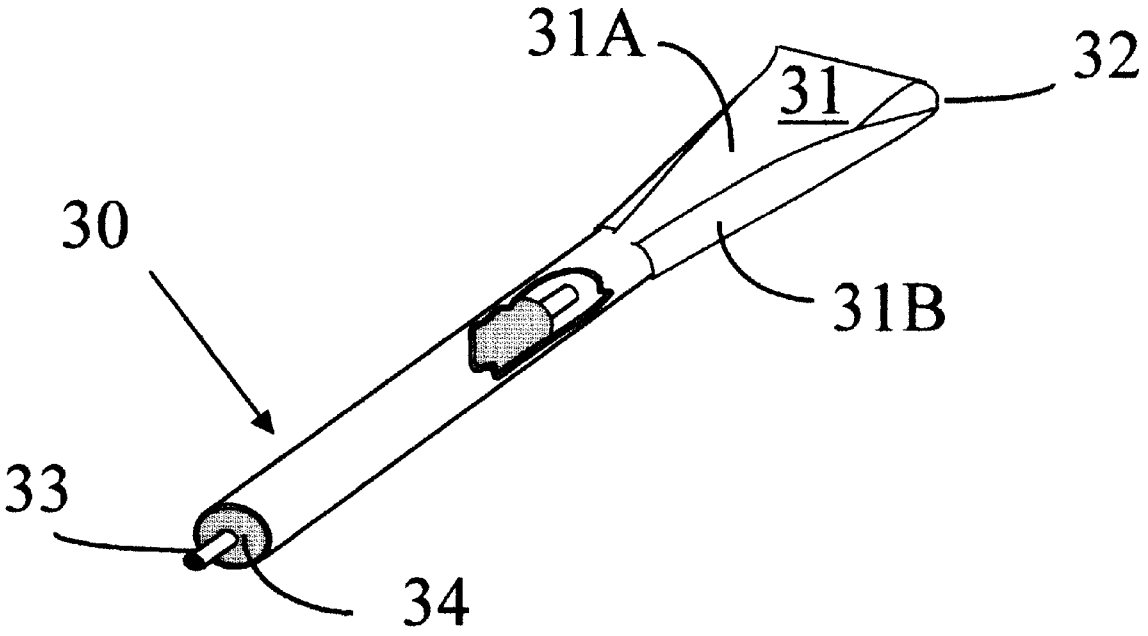
FIG. 1 is an isometric view of the adjustable length writing instrument in its extended and operational mode.
Figure 2:
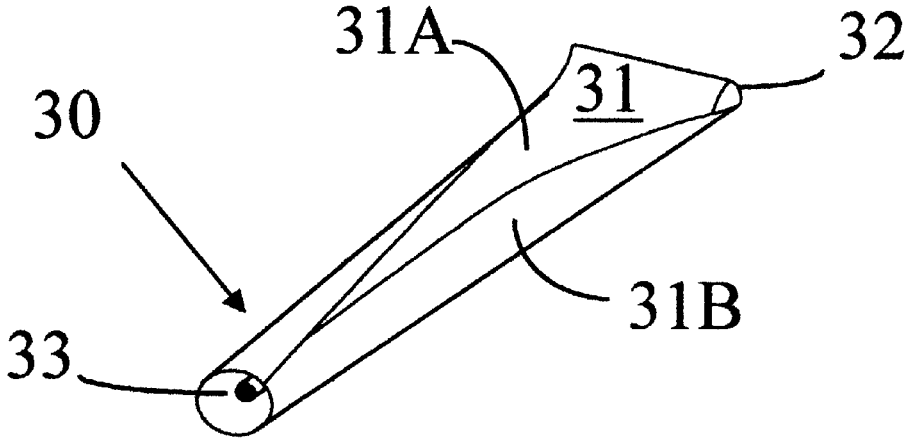
FIG. 2 is an isometric view of adjustable length writing instrument in its contracted and storage mode.

The embodiment of the adjustable-length writing instrument is illustrated in FIG. 1 (extended and operational mode) and FIG. 2 (contracted and storage mode).

The embodiment 30 consist of a substrate 31, divided into an inner portion 31A and an outer portion 31B by means of a fold 32, a means of writing 32, and an optional support layer 33 between the inner portion and means of writing.

Advantages

From the description above, a number of advantages of the adjustable length writing instrument are evident:

In its extended arrangement, the instrument is comfortable to use because it is round and conformable to the fingers at one end and adjustable to fit comfortably flat against the base of the hand on the other end.

In its contracted arrangement, the instrument is much shorter than standard length (about half) and smaller in volume (again about half), allowing it to easily fit horizontally at the bottom of a shirt or pants pocket. At the bottom of a pocket, it is not seen but also does not cause discomfort or damage when the person sits.

In either the extended or contracted position, the instrument is relatively light and flexible, making it more comfortable for use and storage.

The instrument is very simple with as few as two parts, reducing the chances of breaking, jamming, or wearing-out. Furthermore, all the parts are permanently connected, avoiding loss of parts (such as a cap).

The instrument is easy to reconfigure. With one hand and about one second, the user can reconfigure the instrument from contracted to extended or visa versa.

In the contracted configuration, the writing cartridge is fully contained in the substrate, preventing unintended markings.

Operation

Operation of the embodiment is the same as with the standard writing instrument. The hand supports and moves the instrument across a surface to write.

However, to contract the instrument, the operation is different. The user holds the outer portion of the substrate still while their thumb (or finger) rests on the exposed part of the inner portion and slides it towards the fold until it is fully inside the outer portion.

To extend the instrument, the user holds the outer portion still while their thumb slides the inner portion away from the fold and to the desired length.

Conclusions. Ramifications, and Scope

This invention is an advanced concept for a comfortable, standard-length writing instrument that can be quickly contracted into about half-length for easy and practical storage.

Furthermore, it is light, flexible and simple, making it more comfortable to use and carry. The instrument can be stored and used in places not possible with a typical writing instrument.

This invention may be embodied in other specific forms without departing from the spirit of essential characteristics thereof, The present embodiments is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An adjustable-length instrument for writing, comprising:

a flexible, substrate having an outer portion and an inner portion which are foldable at a line between the outer portion and the inner portion, and the inner portion slides inside the outer portion to change the length of the instrument, a means for writing, including a pencil or ink cartridge supported by and attached to the inside of the inner portion of the substrate.

2. The writing instrument of claim 1 wherein a support layer is added between the substrate and the means for writing.

* * * * *